US012122543B2

(12) United States Patent
Talacci

(10) Patent No.: US 12,122,543 B2
(45) Date of Patent: Oct. 22, 2024

(54) PACKAGING MACHINE FOR PACKAGING IN BAGS AT LEAST ONE PRODUCT

(71) Applicant: PERFECT PACK S.R.L., Rimini (IT)

(72) Inventor: Roberto Talacci, Rimini (IT)

(73) Assignee: PERFECT PACK S.R.L., Rimini (IT)

( * ) Notice: Subject to any disclaimer, the term of this patent is extended or adjusted under 35 U.S.C. 154(b) by 39 days.

(21) Appl. No.: 17/926,785

(22) PCT Filed: May 21, 2021

(86) PCT No.: PCT/IB2021/054416
§ 371 (c)(1),
(2) Date: Nov. 21, 2022

(87) PCT Pub. No.: WO2021/240316
PCT Pub. Date: Dec. 2, 2021

(65) Prior Publication Data

US 2023/0211903 A1 Jul. 6, 2023

(30) Foreign Application Priority Data

May 25, 2020 (IT) ..... 102020000012166

(51) Int. Cl.
*B65B 1/02* (2006.01)
*B65B 43/04* (2006.01)
(Continued)

(52) U.S. Cl.
CPC ..... *B65B 1/02* (2013.01); *B65B 43/04* (2013.01); *B65B 43/12* (2013.01); *B65B 43/26* (2013.01)

(58) Field of Classification Search
CPC ..... B65B 1/02; B65B 43/04; B65B 43/12; B65B 43/26; B65B 43/465; B65B 5/022;
(Continued)

(56) References Cited

U.S. PATENT DOCUMENTS 3,237,369 A * 3/1966 Stroop ..... B65B 35/32 53/526
3,382,644 A * 5/1968 Vogt ..... B65B 1/02 53/562

(Continued)

FOREIGN PATENT DOCUMENTS

| | | |
|---|---|---|
| DE | 2 225 368 | 12/1972 |
| DE | 20 2010 006 222 | 9/2010 |
| JP | 05-026808 | 4/1993 |

OTHER PUBLICATIONS

International Search report issued Sep. 9, 2021 in International (PCT) Application No. PCT/IB2021/054416.

*Primary Examiner* — Hemant Desai
*Assistant Examiner* — Mobeen Ahmed
(74) *Attorney, Agent, or Firm* — Wenderoth, Lind & Ponack, L.L.P.

(57) ABSTRACT

A packaging machine for packaging a product in bags comprises a forming station for making bags from a plastic sheet that includes folding assembly for folding the sheet and obtaining two superimposed flaps, pulling assembly for unwinding the sheet and moving the two flaps on a vertical movement plane along a vertical first advancement direction, welding assembly and cutting devices for making on the flaps bags that are arranged side by side to form bag rows parallel to each other and orthogonal to the first advancement direction; a filling and closing station comprising a dosing station for dosing a product in the bags and a welding station for welding and closing the bags; and a movement system provided with gripping devices mobile and configured to move the bag rows along a second advancement direction from the forming station to the dosing station and the welding station.

14 Claims, 10 Drawing Sheets

(51) Int. Cl.
*B65B 43/12* (2006.01)
*B65B 43/26* (2006.01)

(58) Field of Classification Search
CPC ..... B65B 7/02; B65B 43/06; B65B 43/123; B65B 43/267; B65B 43/50
See application file for complete search history.

(56) References Cited

U.S. PATENT DOCUMENTS 3,383,269 A * 5/1968 Kopp ..... B65B 9/023 493/203
3,451,187 A * 6/1969 Pitts, Sr. ..... B65B 61/06 53/554
3,641,737 A * 2/1972 Tamagni ..... B65B 61/28 53/251
4,355,494 A * 10/1982 Tilman ..... B29C 66/4322 53/139.2
4,611,455 A * 9/1986 Aiuola ..... B29C 66/8221 156/583.1
4,631,901 A * 12/1986 Chung ..... B65B 1/02 53/562
4,730,439 A * 3/1988 Chung ..... B65B 1/02 53/511
4,845,926 A * 7/1989 Davis ..... B29C 65/305 53/554
5,372,000 A * 12/1994 Altermatt ..... B65B 43/52 53/481
5,408,807 A * 4/1995 Lane, Jr. ..... B05C 17/00583 53/554
5,528,883 A * 6/1996 Jamison ..... B65B 1/02 53/244
5,862,653 A * 1/1999 Solano ..... B65B 43/465 53/562
6,189,293 B1 * 2/2001 Kraft ..... B65G 47/32 53/284.7
6,233,903 B1 * 5/2001 Ide ..... B65B 41/16 53/551
6,343,876 B2 * 2/2002 Takahashi ..... B29C 66/4322 116/DIG. 17
6,761,016 B1 * 7/2004 Soleri ..... B29C 66/4322 53/554
7,412,812 B2 * 8/2008 Wild ..... B67C 3/045 53/127
7,430,843 B2 * 10/2008 Wild ..... B65B 59/001 53/469
7,516,596 B2 * 4/2009 Henderson ..... B29C 66/1122 53/131.5
7,581,370 B2 * 9/2009 Koga ..... B65B 43/123 271/69
7,726,105 B2 * 6/2010 Talacci ..... B29C 66/81427 53/553
7,937,916 B2 * 5/2011 Thierig ..... B31B 70/00 53/562
7,954,307 B2 * 6/2011 Paunesku ..... B65B 43/04 53/469
8,511,458 B2 * 8/2013 Setozaki ..... B65B 43/12 493/267
9,617,019 B2 * 4/2017 Smith ..... B65B 39/145
10,336,559 B2 * 7/2019 Koga ..... B65G 54/02
10,569,916 B2 * 2/2020 Sander ..... B65B 43/465
10,640,251 B2 * 5/2020 Campagnoli ..... B65B 43/60
10,730,647 B1 * 8/2020 Olson ..... B65B 43/00
10,773,847 B2 * 9/2020 Bellante ..... B65G 54/02
10,882,651 B2 * 1/2021 Wang ..... B65B 7/02
10,996,232 B2 * 5/2021 Moore ..... G01N 35/04
11,091,284 B2 * 8/2021 Nakamoto ..... B65B 43/52
11,142,358 B2 * 10/2021 Schubert ..... B65B 11/12
11,351,715 B2 * 6/2022 Sauter ..... B29C 49/70
11,407,535 B2 * 8/2022 Oshima ..... B65B 31/024
2004/0014577 A1 * 1/2004 Hiramoto ..... B29C 65/7882 493/197
2004/0177735 A1 * 9/2004 Nakagiri ..... B65H 31/3081 83/78
2004/0206056 A1 * 10/2004 Hiramoto ..... B65B 5/022 53/562
2005/0238766 A1 * 10/2005 Henderson ..... B65B 9/2042 426/106
2007/0084154 A1 * 4/2007 Kissling ..... B65B 9/023 53/551
2008/0072547 A1 * 3/2008 Murray ..... B65B 9/08 53/451
2008/0131244 A1 * 6/2008 Murray ..... B65B 51/146 414/373
2008/0172989 A1 * 7/2008 Deep ..... B65B 9/02 53/451
2009/0056281 A1 * 3/2009 Murray ..... B65D 75/5883 493/267
2010/0162664 A1 * 7/2010 Setozaki ..... B65B 43/12 53/558
2010/0180554 A1 * 7/2010 Rapparini ..... B65B 65/02 198/836.1
2011/0036741 A1 * 2/2011 Moehlenbrock ..... B65B 9/213 493/264
2012/0289391 A1 * 11/2012 Murray ..... B65B 1/02 493/227
2013/0126097 A1 * 5/2013 Murray ..... B29C 66/81431 156/538
2013/0152516 A1 6/2013 Sammons et al.
2017/0088298 A1 * 3/2017 McLenithan ..... B65B 61/06
2017/0129633 A1 * 5/2017 Arai ..... B29C 66/8242
2017/0313456 A1 * 11/2017 Sander ..... B65B 43/16
2018/0354220 A1 * 12/2018 Peebles ..... B65B 43/42
2019/0233152 A1 * 8/2019 Nakamoto ..... B65B 51/32
2019/0375530 A1 * 12/2019 Mora Flores ..... B65B 43/32
2020/0369417 A1 * 11/2020 Pieper ..... B65B 43/12
2022/0106065 A1 * 4/2022 Morral Roca ..... B65B 51/225
2022/0219852 A1 * 7/2022 Matsuhisa ..... B65B 39/007

* cited by examiner

PACKAGING MACHINE FOR PACKAGING IN BAGS AT LEAST ONE PRODUCT

The invention relates to machines for packaging products and in particular to a packaging machine adapted to package pharmaceutical, cosmetic and food products in powder, granules, tablets, capsules, fluids in envelopes or in plastic bags.

In the pharmaceutical and cosmetic field, the use of four-weld bags, i.e., rectangular bags hermetically closed on all four sides, is widespread.

Packaging machines are known for packaging four-weld bags starting from a sheet of plastic material which are defined "vertical" in that the stations and operating means which form, weld and fill the bags with a product are arranged in sequence along a vertical advancement direction along which the sheet and subsequently the bags are moved.

The known vertical packaging machines typically comprise one or more dispensing tubes arranged vertically parallel and adjacent to each other, which are partially inserted between two sheets of single or multilayer plastic, superimposed and moved on a vertical plane from top to bottom, i.e., with vertical unwinding or advancement direction. The two sheets are generally obtained by longitudinally folding and cutting a single plastic sheet unwound from a reel.

The dispensing tubes are connected at the top to a dosing device so as to receive from the latter the product which is released in predetermined doses inside the individual bags open at the top, i.e., before the latter are completely closed by the welding means. To this end, an end portion of each dispensing tube is inserted into the respective bag while the latter is made by the welding means.

The welding means comprise a first welding unit which performs the longitudinal welds of the bags, i.e., vertical welds parallel to the advancement direction of the sheet and a second welding unit which makes the transverse welds of the bags, i.e., welds horizontal and orthogonal to the advancement direction.

The first welding unit is positioned at the dispensing tubes to make the longitudinal welds next to the end portions of the latter, while the second welding unit is placed below the dispensing tubes so as to make the closed bottom of the bags to be filled which are open above and to close an open upper edge of the bags previously filled with the product.

Alternatively, the welding means can comprise a single welding unit which makes "U"-shaped welds i.e., which simultaneously makes longitudinal and transverse welds.

The welding means allow to create one or more vertical rows of bags parallel to each other and to the advancement direction on the two superimposed sheets, a respective dispensing tube being provided for each vertical bag row.

Typically, the known vertical packaging machines make a plurality of vertical bag rows in order to have a high production compared to a limited length of the machine itself.

Downstream of the second welding unit, transverse cutting means are provided to perform a horizontal cut orthogonal to the advancement direction which allows the separation of one horizontal bag row at a time. Upstream of the transverse cutting means, longitudinal cutting means can be provided to perform one or more vertical cuts parallel to the advancement direction based on the number of vertical bag rows made by the welding means so as to obtain individual bags.

Vertical packaging machines can operate intermittently or continuously.

However, the known vertical packaging machines have the disadvantage of being able to dose a maximum of two distinct products into the bags, and preferably only one product, due to the manner in which the bags are formed and filled by means of the dispensing tubes inserted inside the bags, which are typically small.

Another disadvantage of these packaging machines lies in the fact that the product is dosed simultaneously or immediately after making the welds necessary to form the pocket in which to release the product along the three sides of the bag. The latter then comes into contact with portions of the bag which are still hot following the welding. However, exposure to heat for some types of products, in particular pharmaceutical products, is not recommended because it can lead to a deterioration and/or alteration of the products themselves.

Furthermore, since the dosing device with the product tank is placed above the welding means, it is subject to the heat developed by the welding means and over time, during operation, it is progressively heated and the product it contains is heated therewith. To overcome such a drawback and avoid exposure to heat, the dosing device must be suitably insulated, resulting in an increase in the complexity and cost of the packaging machine.

So-called horizontal packaging machines are also known, in which the stations and the means which form, weld and fill the four-weld bags with a product are arranged in succession typically along a horizontal advancement direction and the bags are arranged so as to lie on a vertical plane, moved through the machine and along the aforementioned advancement direction with intermittent motion.

Such machines typically comprise folding means which make two superimposed sheets, which are arranged perpendicular to a support plane of the packaging machine, from a sheet of plastic material unwound from a reel, typically on a vertical plane and are moved along the horizontal advancement direction.

Downstream of the folding means a first welding station is included which performs the welding of the two lateral edges and the lower edge of the bags leaving open the edge or upper side through which one or more products are dosed in one or more subsequent dosing stations. A second welding station downstream of the dosing station(s) provides for welding and closing the upper edge of the bags.

Transverse cutting means are generally included upstream of the dosing station to separate the bags individually or grouped in rows of defined number.

Welding, dosing and cutting operations are performed during the stopping steps of the intermittent motion by the packaging machine.

In horizontal packaging machines, the dosing station is suitably spaced from the welding means of the three sides of the bags so as to dose the product "cold", i.e., in bags which have now completely cooled down in all the parts thereof after the welding, so as to avoid any deterioration or alteration of the product, in particular pharmaceutical.

The horizontal packaging machines can comprise a plurality of dosing stations, arranged in succession along the horizontal advancement direction to dose respective different products.

However, the number of dosing stations conditions the overall length of the packaging machine.

The length of the machine further depends on the advancement pitch of the intermittent motion; such a pitch is defined by the width and number of bags on which the successive and different welding, cutting and dosing operations are performed at the same time. Since the width of the advancement passage also determines the productivity or packaging speed of the packaging machine (in particular, the productivity increases or decreases with the increase or decrease of the aforementioned advancement pitch width), the latter, in order not to have an excessive length and footprint, necessarily has a limited productivity.

DE 2225368 discloses a machine for forming and filling bags consisting of sheet material which is pulled from a reel and cut by a sheet cutting device; the machine comprises means for positioning each sheet in front of a folding blade adapted to fold the latter into two parts and insert it with the folding edge between adjacent portions of pairs of superimposed and intermittently operated transfer belts. Cutting means are arranged along the adjacent portions which are adapted to cut the sheet perpendicular to the folding edge into a plurality of parts and cooperating with welding means which weld the superimposed lateral edges of each part in order to form bags. The lower belts of the pairs of belts are provided with protrusions which at each advancement pitch of the belts themselves engage the opening side of the bags and push each of them between the jaws of a respective pair of grippers adapted to tighten on the welded lateral edges of each bag near the introduction opening of the latter; a gripper is supported slidable and approachable with respect to the other grippers by pushing means operated after the grippers have grasped the welded edges to cause the enlargement of the introduction opening of the bags; the pairs of grippers are mounted on an endless line for the transfer of the bags to a filling station.

It is an object of the invention to improve the known packaging machines, in particular the packaging machines configured to package pharmaceutical, cosmetic and food products in fluid, powder, granule, tablet, capsule form, etc. in bags obtainable by folding and welding a sheet or film of plastic material.

Another object is to make a flexible and versatile packaging machine which allows one or more different products to be dosed in bags which are at room temperature in all the parts thereof, so as to avoid any deterioration and alteration of the products, in particular of the pharmaceutical type, due to heat.

A further object is to obtain a packaging machine which allows to create high quality packaging while achieving high production speeds.

The invention includes a packaging machine for packaging bags as defined in independent claim 1.

The wrapping machine of the invention configured to package at least one product in bags comprises a forming station adapted to make bags from a sheet of plastic material and comprising folding means for folding the sheet and obtaining two superimposed flaps, pulling means for unwinding the sheet from a reel and moving the two superimposed flaps on a substantially vertical movement plane along a first substantially vertical advancement direction, welding means and cutting means for making bags which are welded on three sides and arranged side by side to form a plurality of bag rows parallel to each other and orthogonal to the first advancement direction, each bag comprising an access opening along a respective upper side. The packaging machine further comprises a filling and closing station comprising at least one dosing station for dosing a product in the bags and a welding station for welding and closing the bags at the upper side, and a movement system comprising a plurality of gripping devices which are mobile and configured to move the bag rows along a second advancement direction from the forming station to at least one dosing station and subsequently to the welding station, each bag row being kept substantially aligned orthogonally to the second advancement direction during the movement from the forming station to, and through, the filling and closing station.

By virtue of the packaging machine of the invention it is possible to dose one or more products inside the bags when the latter are at room temperature in order to avoid deterioration and alteration of the products themselves, in particular in the case of pharmaceutical products. The at least one dosing station positioned in the filling and closing station and in which the bags are filled with the product or products, is in fact separate and distant from the forming station, in which the three lateral and lower edges of the bags are welded. Thereby, it is possible to have the plastic material of the bags completely cooled in all the parts thereof before the filling with the product.

The packaging machine of the invention is also very flexible and versatile since it allows to dose a plurality of different products by including respective dosing stations in the filling and closing station without significantly increasing the dimensions and longitudinal footprint of the packaging machine. Such an advantage is also obtained by virtue of the forming station in which the folding, welding and cutting means are arranged along a vertical movement plane having a limited overall plan footprint.

The invention can be better understood and implemented with reference to the attached drawings which illustrate some exemplifying and non-limiting embodiments thereof, in which.

Figure 1:
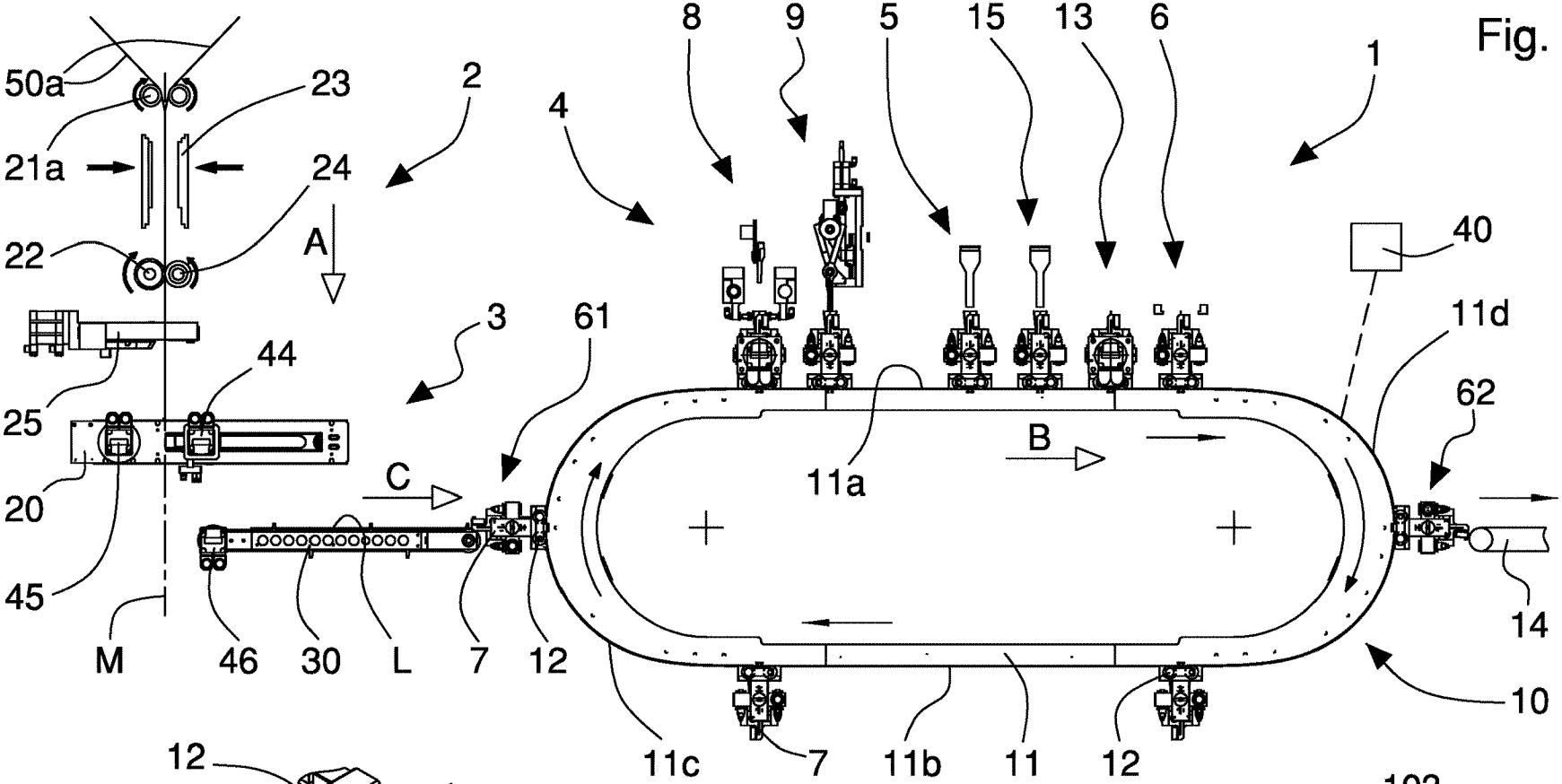
FIG. 1 is a schematic side view of the packaging machine of the invention for packaging bags with four side welds.

Referring to FIGS. 1 to 13, the packaging machine 1 according to the invention is illustrated arranged to package at least one product in bags 100, in particular pharmaceutical, cosmetic or food products which are fluid, powder, granules, tablets, capsules, bars, etc. More precisely, the packaging machine 1 of the invention is capable of making bags 100 by appropriately folding, welding and cutting a single or multilayer sheet or film 50 of plastic material, inserting predefined doses of one or more products into the bags 100 thus made. The bags 100 made are, for example, of the four-weld type i.e., rectangular bags hermetically closed by welding along the four sides.

The packaging machine 1 comprises a forming station 2 arranged to make bags 100 from a sheet 50 of plastic material which are opened at a respective lateral or upper edge 103, a filling and closing station 4 arranged to dose one or more products into the bags 100 and then close and weld the upper edges of the latter and a movement system 10 to move the bags 100 from the forming station 2 to, and through, the filling and closing station 4.

Figure 2:
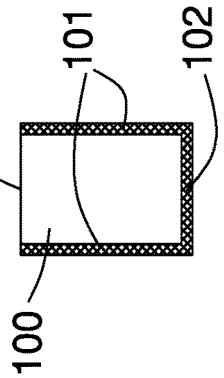
FIG. 2 is a front view of a four side-weld bag with an open upper edge, made by the packaging machine of FIG. 1.
Figure 5:
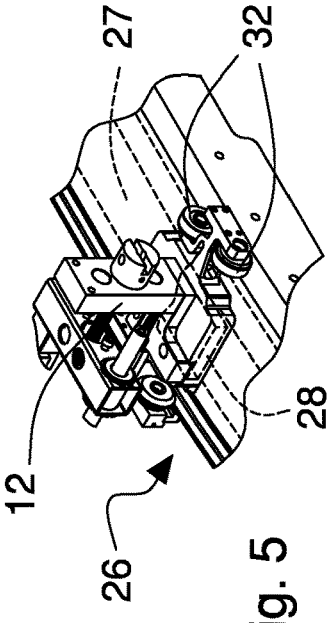
FIG. 5 is an enlarged partial view of FIG. 4 illustrating a movement carriage of a movement system of the bag of the packaging machine of the invention.

More in detail, the forming station 2 comprises folding means 21 for folding the sheet 50 and obtaining two superimposed flaps 50*a*, pulling means 22 for unwinding the sheet 50 from a reel 51 and moving the two superimposed flaps 50*a* on a movement plane M, substantially vertical, along a first advancement direction A, also substantially vertical. The forming station 1 also comprises welding means 23 and cutting means 24, 25 configured for making on the flaps 50*a* a plurality of bags 100 which are welded on three sides or edges and arranged side by side to form a plurality of bag rows 110 parallel to each other and orthogonal to the first advancement direction A, i.e., horizontal bag rows, in which each bag 100 comprises an access opening along a respective lateral or upper edge 103. More precisely, as illustrated in FIG. 2, the forming station 2 allows to make a plurality of bags 100 opened at the upper side or edge 103 and hermetically closed along respective welded lateral edges 101 and lower edge 102.

The filling and closing station 4 comprises at least one dosing station, or substation, 5, 15 for dosing a product in the bags 100, through the access openings, and a welding station, or substation, 6 for welding and closing the bags 100 at the respective upper sides 103.

The movement system 10 is further configured to transfer the bag rows 110 filled with the product to further movement means 14 for exiting from the packaging machine 1.

The movement system 10 comprises a plurality of gripping devices 7 which are movable and configured to move the bags 100 along a substantially horizontal second advancement direction B from the forming station 2 to the dosing station 5, 15 and subsequently to the welding station 6 of the filling and closing station 4. Each bag row 110 is kept, in particular by the gripping devices 7, orthogonal to the second advancement direction B during the movement from the forming station 2 to, and through, the filling and closing station 4. Each bag row 100 supported by the respective gripping device 7 lies aligned on a respective vertical plane, with the upper edges 103 of the bags 100 facing upwards.

In the illustrated embodiment, the filling and closing station 4 comprises a dosing station 5 and a further dosing station 15 arranged to dose respective products in the bags 100.

Each dosing station 5, 15 comprises respective dispensing means, of known type and not described and illustrated in the figures, arranged to dispense into the bags 100 of each bag row 110 a respective product in fluid, powder, granules, etc. by means of a plurality of special dispensers 48 and further dispensers 49 movable vertically so as to approach the bags 100 during the product dispensing step.

It is also provided that the filling and closing station 4 of the packaging machine 1 of the invention can comprise a single dosing station 5 or three or more dosing stations arranged in succession along the second advancement direction B to dose different products.

The welding station 6 comprises respective welding means 60 adapted to weld and hermetically close an upper edge 103 of the bags 100 after dosing the product(s). The welding means of the welding station 6 comprise a pair of welding bars 60 movable with respect to each other so as to abut, press and weld the upper edges 103 of the bags 100 in a closed position.

The filling and closing station 4 further comprises an opening station 8 in which the bags 100 are opened i.e., are crushed laterally so that the opposite walls detach at the upper side 103, not yet welded, to form a spreading apart of the product access opening in the bag, as better explained in the following description.

The opening station 8 is placed upstream of the dosing station 5 with reference to the second advancement direction B.

An opening control station 9 is preferably interposed between the opening station 8 and the dosing station 5 and comprises a plurality of feeler elements 29. Each feeler element 29 is vertically movable so as to fit inside a bag 100 if the access opening has been properly spread apart in the opening station 8, or to abut the upper side 103 of a bag 100 when the access opening has not been sufficiently spread apart. In the latter case, stopping the feeler element 29 against the upper side 103 of the bag 100 causes an alarm signal to be sent to a control unit 60 of the packaging machine 1.

The filling and closing station 4 also comprises a closing station, or substation, 13 arranged to close the access openings of the bags 100 after they have been filled with the product(s), i.e., arranged to bring the opposite walls of the bag 100 closer together and abut against each other so as to close the bag at the top.

The closing station 13 is interposed between the further dosing station 15 and the welding station 6.

The movement system 10 comprises at least one guide rail 11 which extends along a closed loop movement path, arranged on a substantially vertical plane and a plurality of movement carriages 12 movable along the guide rail 11 and supporting respective gripping devices 7. More precisely, each movement carriage 12 supports a respective gripping device 7.

In the illustrated embodiment, the movement system 10 comprises a pair of guide rails 11 positioned parallel to each other and spaced apart, which support respective pluralities of movement carriages 12 and are in turn supported by a support frame of the packaging machine 1 not illustrated in the figures. Each gripping device 7 is supported at the two opposite ends and moved by two movement carriages 12 associated with the respective guide rails 11.

Each guide rail 11 comprises a first straight operating section 11*a* along which at least the dosing stations 5, 15 and the welding station 6 are positioned and a second straight and parallel return section 11*b*, below the first operating section 11*a*. Each guide rail 11 further comprises a third curvilinear section 11*c* and a fourth curvilinear section 11*d* interposed between the first operating section 11*a* and the second return section 11*b*.

Figure 3:
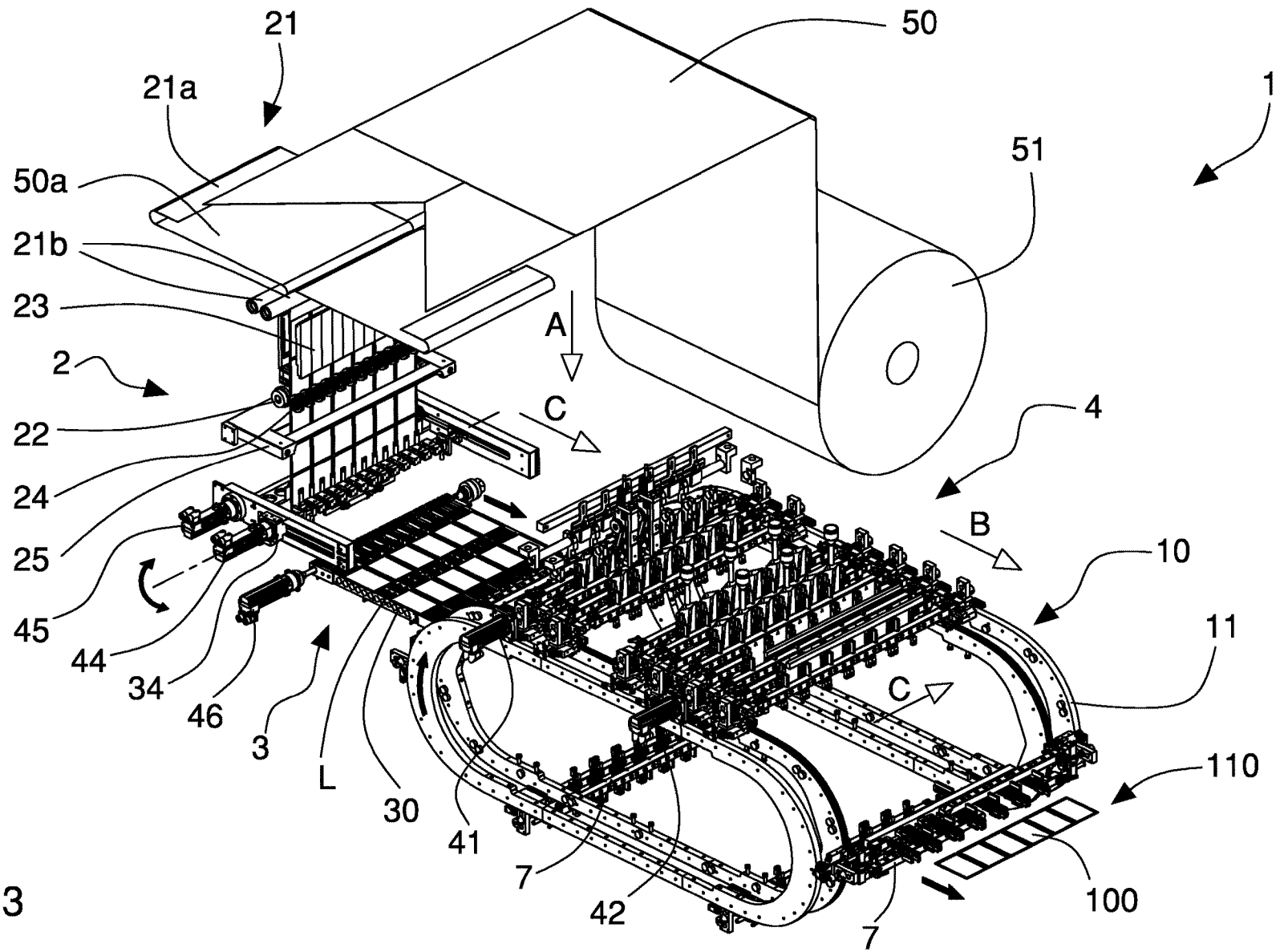
FIG. 3 is a schematic front and perspective view of the packaging machine of FIG. 1.

The movement system 10 comprises a pair of linear electric motors 26 each of which having a stator 27, associated with the respective guide rail 11, and a plurality of rotors 28, each of which associated with a corresponding movement carriage 12 and interacting separately and independently with magnetic fields generated by the stator 27 itself (FIG. 3). Each movement carriage 12 is provided with a plurality of wheels 32 adapted to abut and rotate on an outer surface of the respective guide rail 11.

The linear electric motors 26, of known type and therefore not described and illustrated in further detail, are capable of moving each of the movement carriages 12 separately and independently, in particular with a different law of motion based on the section of the guide rail 11 which is travelled. The linear electric motors 26 are also configured to simultaneously move the pairs of movement carriages 12 which support and move a single respective gripping device 7 with the same law of motion. For this purpose, the linear electric motors 26 are for example controlled by the control unit 40 of the packaging machine 1.

In fact, the control unit 40 is connected to the movement system 10 and also configured to move the movement carriages 12 with intermittent motion along the first straight operating section 11*a* of the guide rails 11, at the various operating stations including the dosing stations 5, 15 and the welding station 6, and with a continuous motion along the second straight return section 11*b* of the guide rails 11, as better explained in the following description. The movement carriages 12 are moved with intermittent motion also along part of the third and fourth curvilinear sections 11*c*, 11*d*.

In a variant of the packaging machine 1 not illustrated in the figures, the movement system 10 can comprise, in place of the guide rails and the magnetically guided movement carriages, mobile conveyor means, and extending along the closed loop movement path and capable of supporting and moving the plurality of gripping devices 7 regularly spaced apart from each other. The conveyor means comprise for example a conveyor or a series of belts wound on pulleys to which the gripping devices 7 are fixed.

Each gripping device 7 comprises a plurality of pairs of grippers 16, 17 arranged aligned according to a transverse direction D substantially orthogonal to the second advancement direction B. Each pair of grippers 16, 17 is configured to grasp the lateral edges 101 of a respective bag 100 and hold said bag 100 upright at the first operating section 11*a* of the guide rails 11. More precisely, each pair of grippers comprises a first gripper 16 and a second gripper 17 fixed and supported to a first support crosspiece 36 and to a second support crosspiece 37 of the gripping device 7. The support crosspieces 36, 37 are arranged parallel to the transverse direction D and are slidably supported at opposite ends by a pair of movement carriages 12, each of which movable along the respective guide rail 11.

Both grippers 16, 17 of each pair of grippers are operated in opening by first actuating means 55 and by second actuating means 56, fixed to the guide rails 11 or to the support frame of the latter at a picking station 61 of the bags and a release station 62 of the bags 100, respectively, of the movement system 10. More precisely and with particular reference to FIG. 7, each of the first grippers 16 and second grippers 17 comprises a respective fixed spout 16*a*, 17*a*, rigidly fixed to the corresponding support crosspiece 36, 37, and a movable spout 16*b*, 17*b* rotatably fixed to the corresponding support crosspiece 36, 37 and held in abutment with the fixed spout 16*a*, 17*a* in a closing configuration of the grippers 16, 17, for example by spring means of a known type and not illustrated.

The movable spouts 16*b*, 17*b* are rotated and detached from the fixed spouts 16*a*, 17*a* in an opening configuration of the grippers 16, 17 by the actuating means 55, 56. The latter comprise respective support crosspieces 55, 56 parallel to the support crosspieces 36, 37 and to the transverse direction D and each of which is provided with a plurality of abutment elements 55*a*, 56*a* arranged to be abutted by operating ends of the movable spouts 16*b*, 17*b*. The operating ends of the movable spouts 16*b*, 17*b* are opposite the gripping ends of the bag 100 and when they abut the abutment elements 55*a*, 56*a* during the movement of the gripping devices 7 along the guide rails 11 they cause the opening of the grippers 16, 17 in the opening configuration, at the picking station 61 for receiving a bag row 110 and the release station 62 for releasing a bag row 110.

The release station 62 of the movement system 10, in which the gripping devices 7 release the bag rows 110 filled with the product to the further movement means 14, is positioned at the third curvilinear section 11*c* of the guide rails 11.

Figure 8:
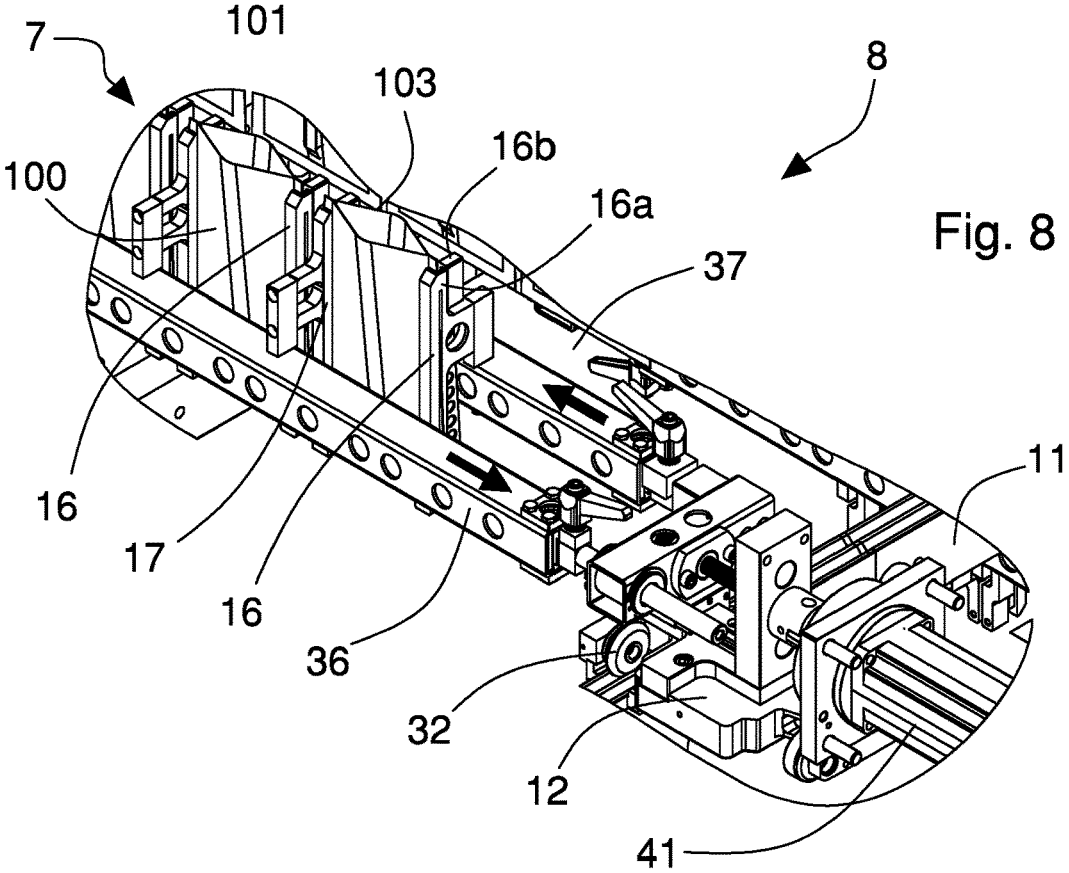
FIG. 8 is a partial enlarged view of FIG. 4 illustrating first operating means of the bag gripping devices at a bag opening station.
Figure 9:
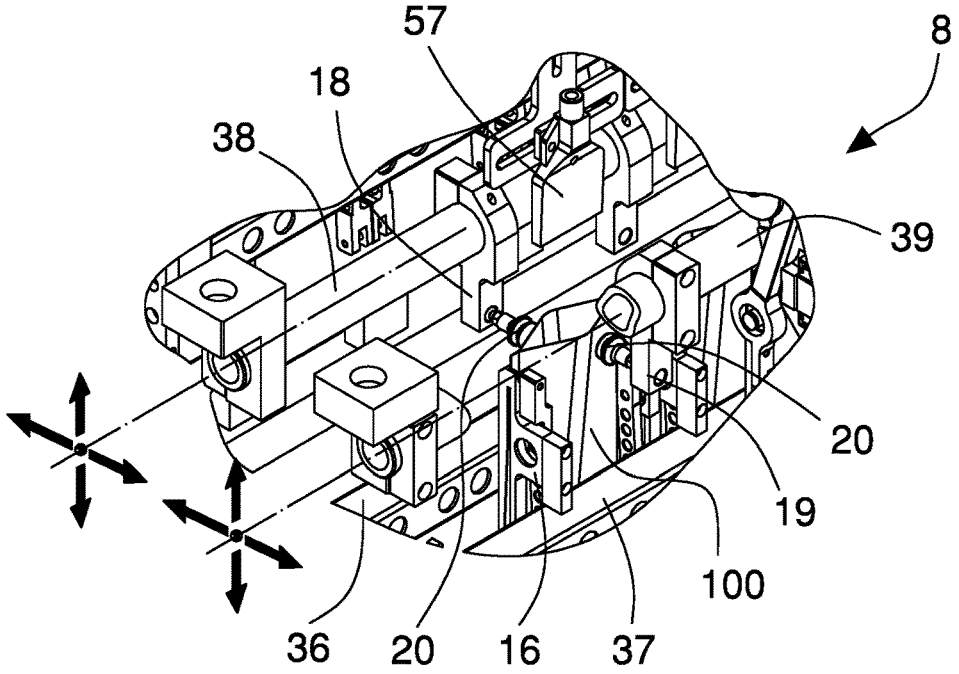
FIG. 9 is a partial enlarged view of FIG. 3, in which some parts have been removed to better illustrate others, which illustrates the gripping elements of the bag in the bag opening station.
Figure 10:
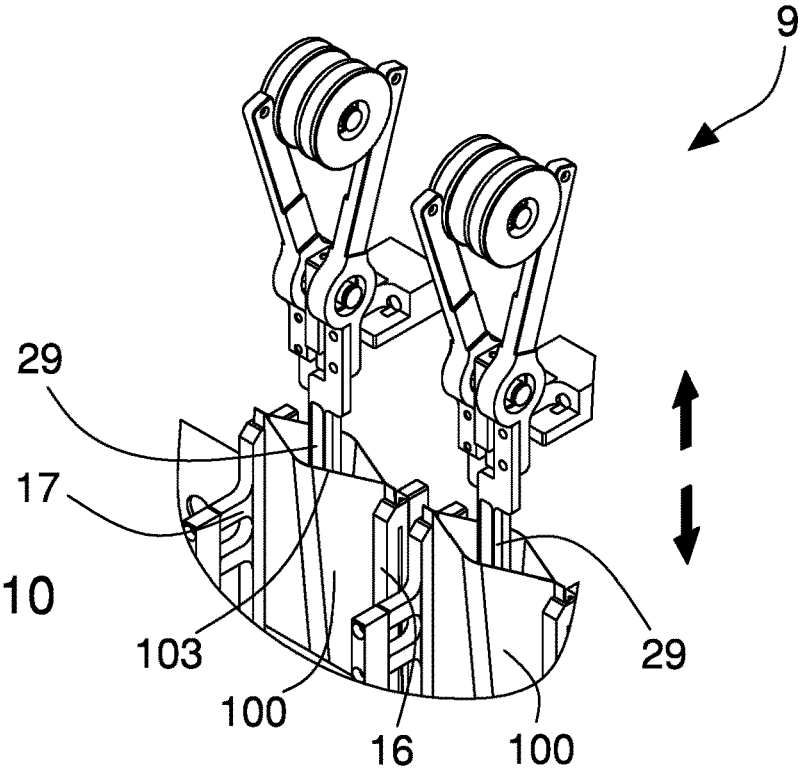
FIG. 10 is a partial enlarged view of FIG. 4 illustrating feeler elements of a bag opening control station.
Figure 11:
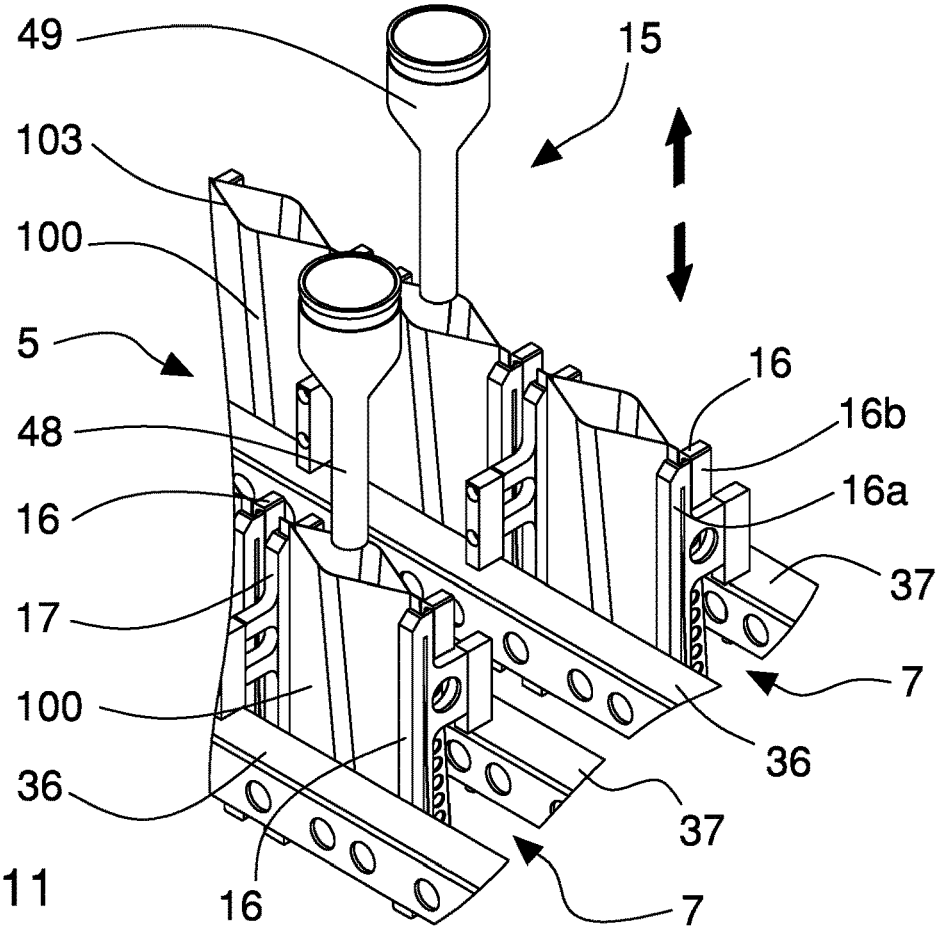
FIG. 11 is a partial enlarged view of FIG. 4 illustrating dosing elements of respective product dosing stations.
Figure 12:
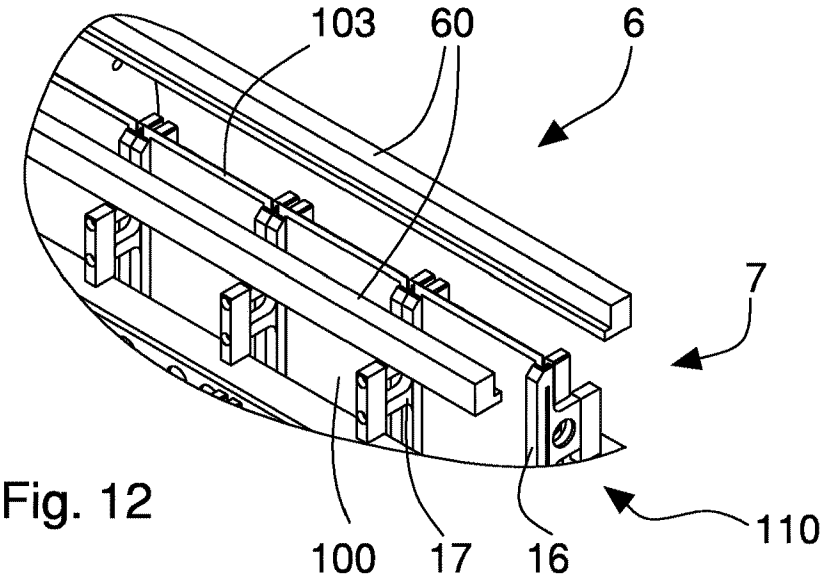
FIG. 12 is a partial enlarged view of FIG. 4 illustrating welding means of a bag welding station.
Figure 13:
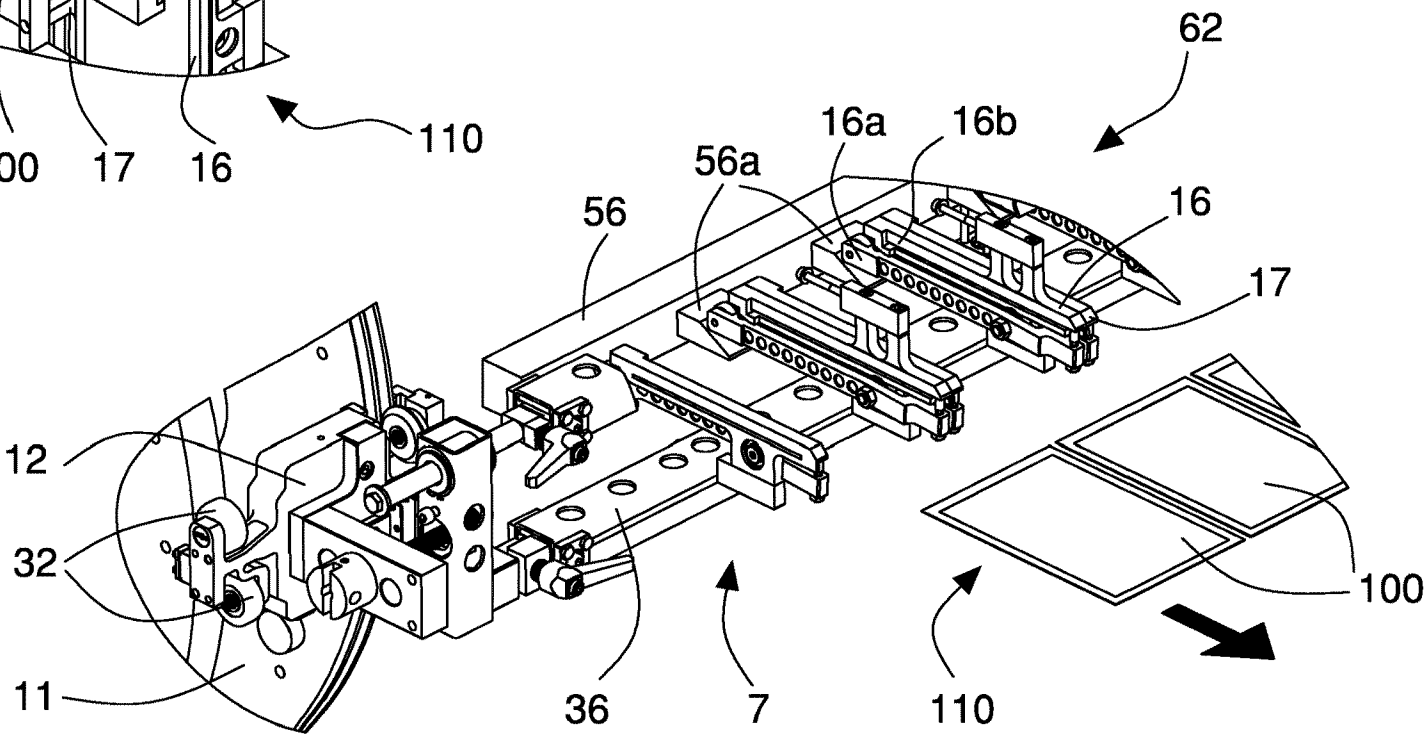
FIG. 13 is a partial enlarged view of FIG. 3 illustrating a bag gripping device in a bag release station.
Figure 14:
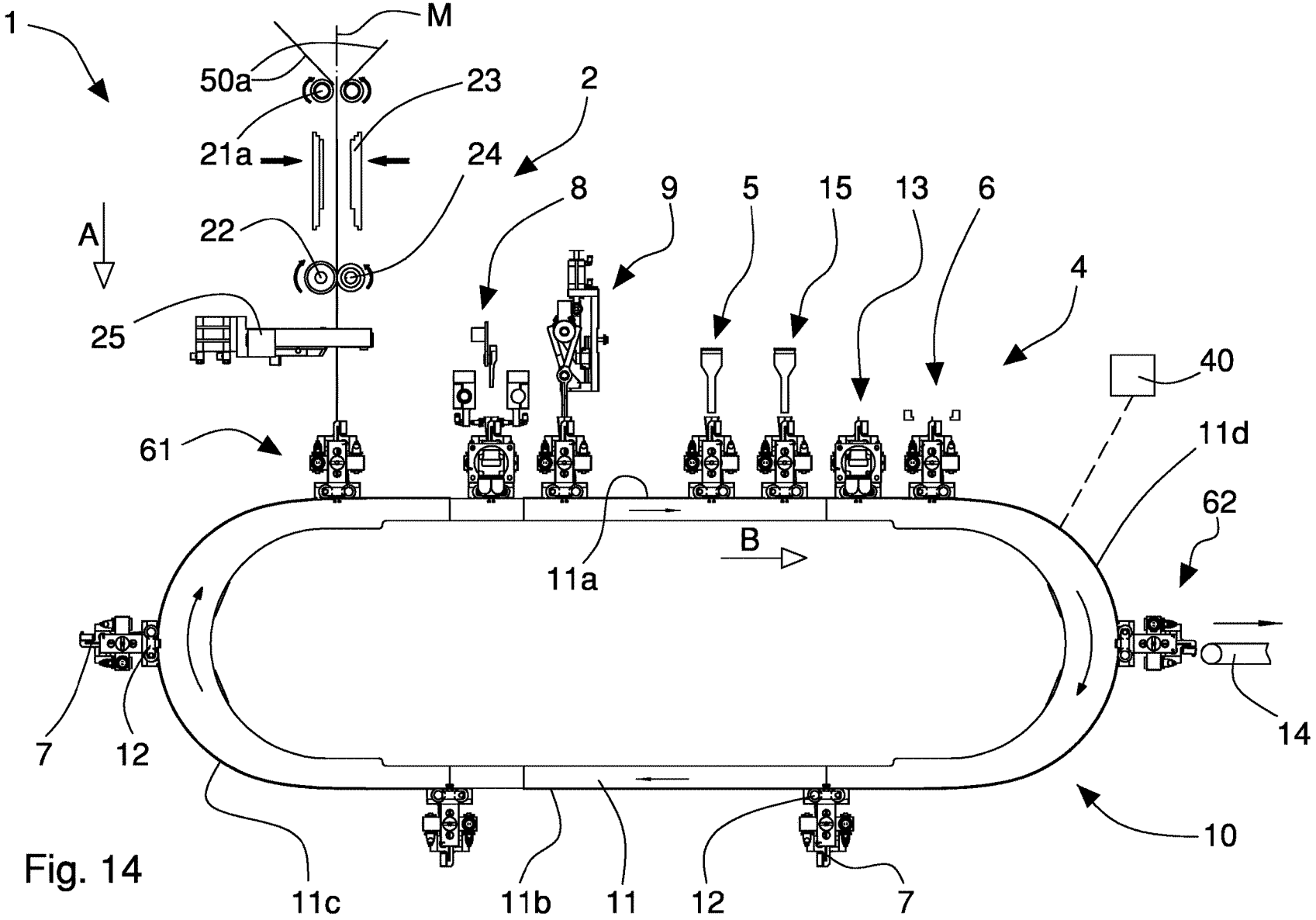
FIG. 14 is a schematic side view of a variant of the packaging machine of the invention.
Figure 15:
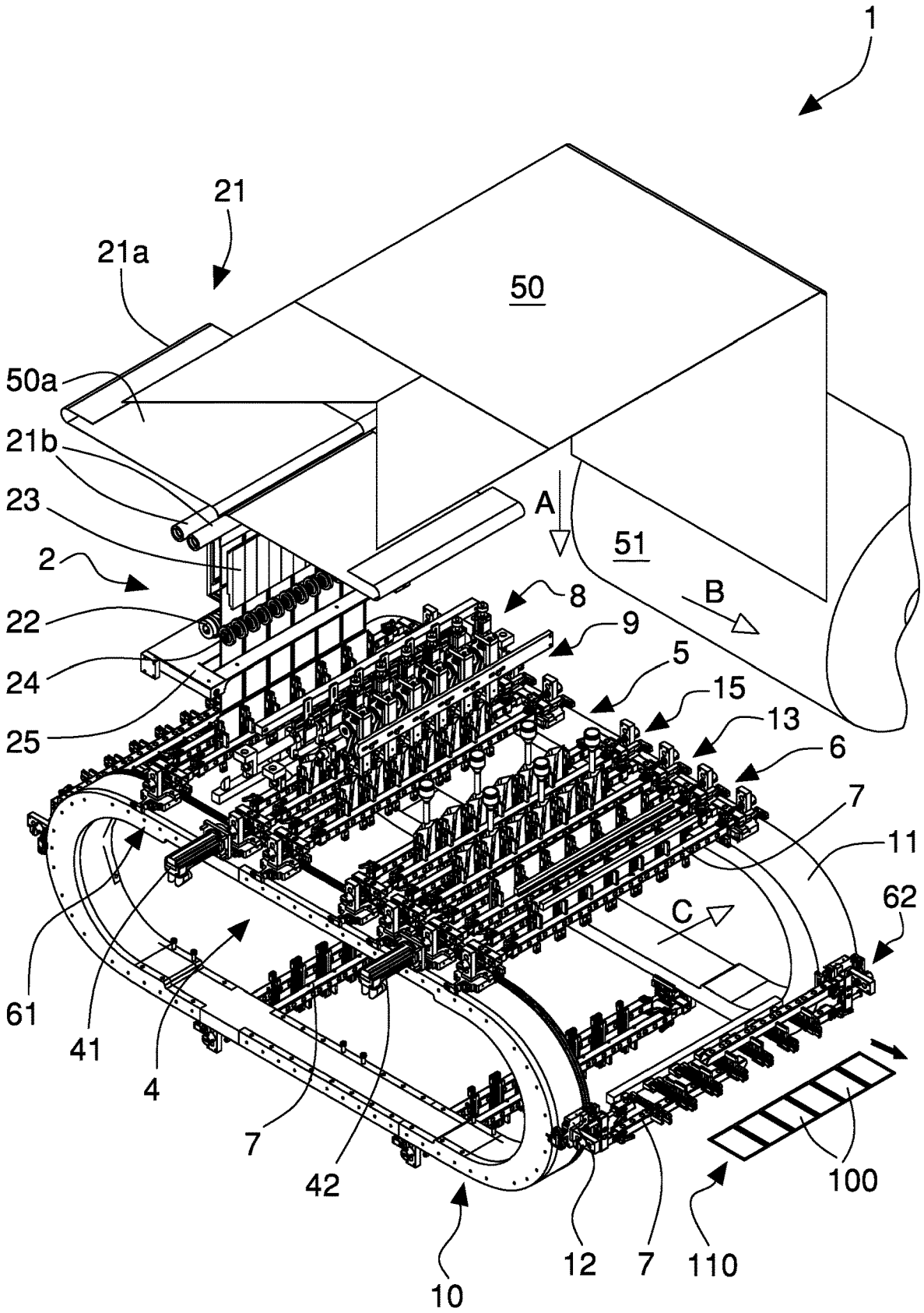
FIG. 15 is a schematic frontal and perspective view of the packaging machine of FIG. 14.
Figure 16:
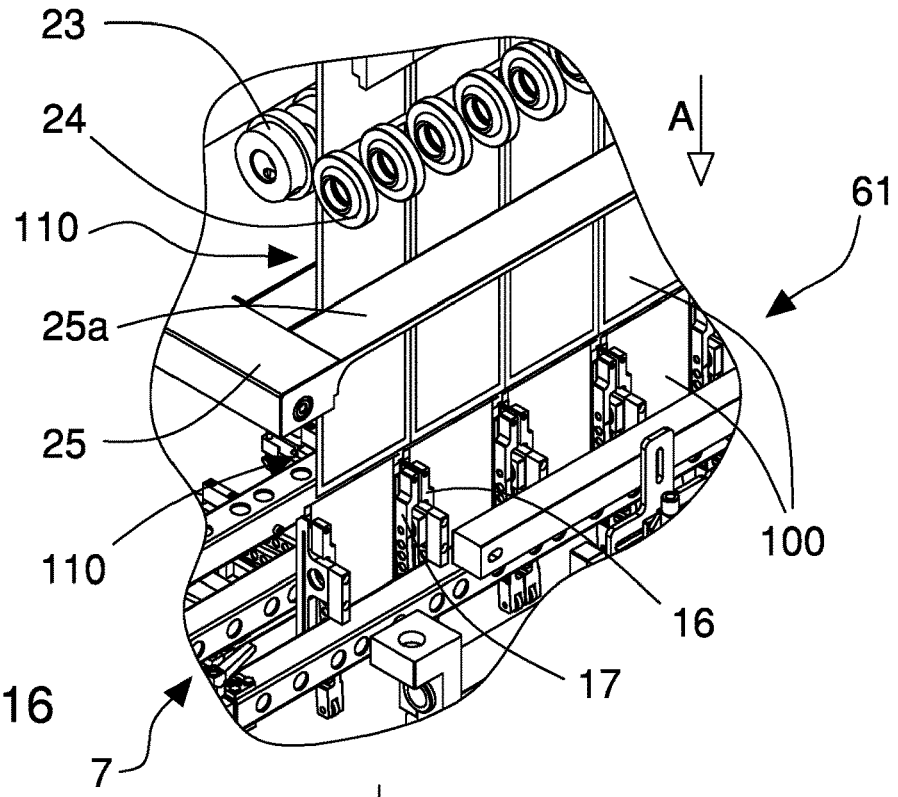
FIG. 16 is a partial enlarged view of FIG. 15 illustrating a picking station of the bags from a forming station.
Figure 17:
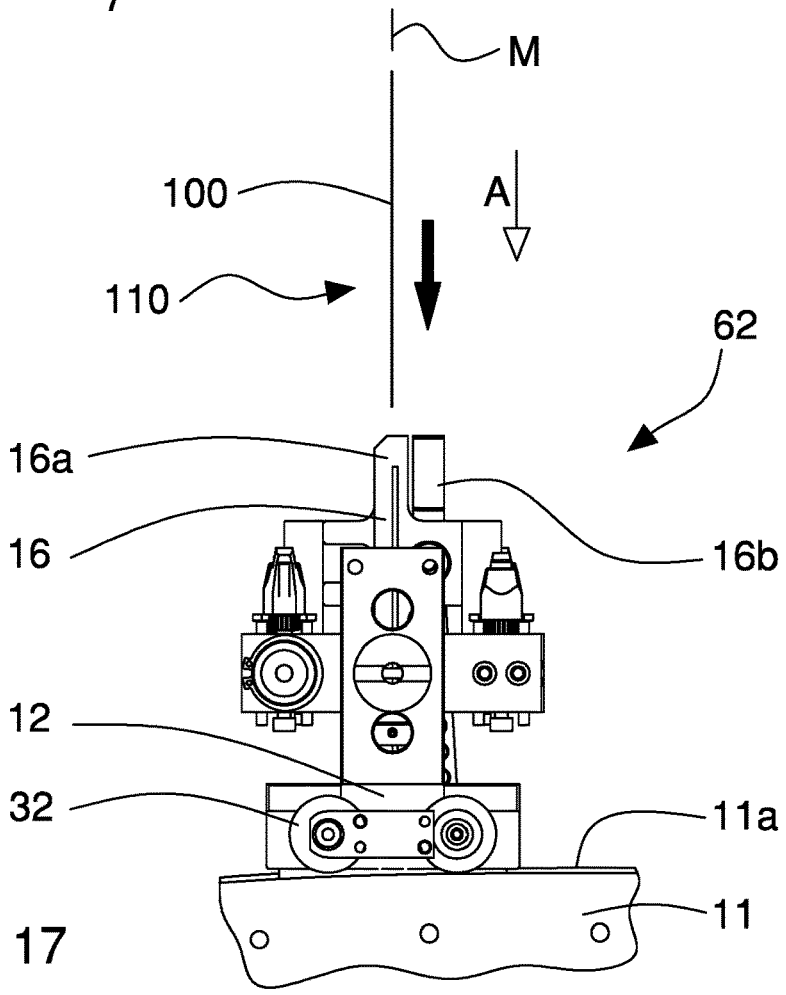
FIG. 17 is a partial enlarged view of FIG. 14 illustrating a gripping device associated with a respective movement carriage at the bag picking station.

The first gripper 16 and the second gripper 17 of each pair of grippers are further movable with respect to each other approaching or moving away along the transverse direction D, respectively, to open the bags 100 (bringing the lateral edges 101 of the latter closer so as to spread apart the access opening at the upper edge 103) and to close the bags 100 (moving the lateral edges 101 of the latter closer so as to bring the access opening closer). To this end, the first support crosspiece 36 and the second support crosspiece 37, to which the first grippers 16 and the second grippers 17 are alternately fixed, are moved along the transverse direction D in opposite directions, in an almost symmetrical or mirrored manner, by first operating means 41 and second operating means 42 fixed to one of the guide rails 11 (FIG. 8).

More precisely, the first operating means 41 positioned at the opening station 8 move the support crosspieces 36, 37 of the gripping devices 7 along the transverse direction D so as to bring the first gripper 16 and the second gripper 17 of each of the pairs of grippers closer together so as to open the bags 100. The second operating means 42, located at the closing station 13, move the support crosspieces 36, 37 of the gripping devices 7 along the transverse direction D so as to move the first gripper 16 and the second gripper 17 of each of the pairs of grippers away from each other so as to open the bags 100.

It should be noted that since the first operating means 41 and the second operating means 42 are configured to move the grippers 16, 17 of each pair of grippers along the transverse direction D symmetrically with respect to a longitudinal axis of symmetry of the aforementioned bags 100, the latter remain aligned or centred with respect to the respective dispensers 48, 49 in the dosing stations 5, 15.

In the opening station 8 there is further provided a plurality of pairs of gripping elements 18, 19 arranged aligned according to the transverse direction D which act as means for spreading apart the bag access openings. In fact, each pair of gripping elements 18, 19 acts on opposite walls of a respective bag 100 so as to move away and detach the opposite walls and spread apart the access opening on the upper edge 103 in cooperation with the pairs of grippers 16, 17. More specifically and with particular reference to FIG. 9, each pair of gripping elements comprises a first gripping element 18 and a second gripping element 19 respectively fixed and supported by a third support crosspiece 38 and a fourth support crosspiece 39. The third and fourth support crosspieces 38, 39 are movable, arranged parallel to the transverse direction D and supported at opposite ends by the guide rails 11 or by the support frame. The gripping elements 18, 19 are, for example, provided with respective suction cups 20 or similar suction means adapted to grasp and move the opposite walls of the bag 100. The third support crosspiece 38 and the fourth support crosspiece 39 are linearly moved by third operating means, not illustrated in the figures, fixed to one of the guide rails 11 along two orthogonal directions of motion, in particular horizontal and vertical, respectively. The third operating means allow the gripping elements 18, 19 to be moved between a disengagement position in which the latter are spaced apart from the bags 100 to allow the movement thereof along the second advancement direction B and operating positions in which the gripping elements 18, 19 abut, grasp, move away and then release the opposite walls of the bags 100. The opening station 8 also comprises a plurality of nozzles 57 arranged aligned along the transverse direction D and in an equal number to that of the bags 100 of each bag row 110 so as to blow respective jets of air on the upper edges 103 of the bags 100 of a bag row 110 so as to facilitate the widening of the access opening.

In the embodiment illustrated in FIGS. 1 to 13, the packaging machine 1 of the invention comprises transfer means 3 configured to transfer the bags 100 from the forming station 2 to the movement system 10. More precisely, the transfer means 3 are configured to pick up and remove the bag rows 110 from the forming station 2 one at a time and then transfer them and release them to the gripping devices of the movement system 10 in the picking station 61 of the latter at the fourth curvilinear section 11*d* of the guide rails 11.

With particular reference to FIGS. 3-6, the transfer means 3 comprise a plurality of pairs of third gripping elements 31 configured to grasp and move respective bags 100 of a bag row 110 coming out of the forming station 2 and picking means 30, interposed between the forming station 2 and the movement system 10. The picking means 30 are arranged to receive the bag rows 110 picked up and released by the third gripping elements 31 and then transfer them to the gripping devices 7 of the movement system 10 in the picking station 61.

The pairs of third gripping elements 31 are movable in rotation around a rotation axis X, parallel to the movement plane M and orthogonal to the first advancement direction A, and linearly along a third advancement direction C to pick up and move each bag row 100 and transfer them to the picking means 30.

The third advancement direction C is, for example, parallel to the second advancement direction B, i.e., almost orthogonal to the movement plane M, i.e., substantially horizontal. The pairs of third gripping elements 31 are also movable with respect to each other along the rotation axis X to space apart the bags 100 of the respective group of bags 110 from each other and allow the grippers 16, 17 of the gripping devices 7 of the movement system 10 to grasp the aforementioned bags 100 at the respective lateral edges 101.

Each third gripping element 31 is provided with a respective suction cup 20 for gripping a wall of the respective bag 100.

The pairs of third gripping elements 31 are fixed to crosspiece means 33 extending parallel to the rotation axis X, along the transverse direction D, and are rotatably supported at opposite ends by two carriages 34.

The carriages 34 are movable along the third advancement direction C, slidably supported by frame means 20 of the forming station 2. Fourth operating means 44 are fixed to one of the carriages 34 and arranged to rotate the crosspiece means 33 around the rotation axis X with alternating motion between a gripping position (FIG. 6), in which the third gripping elements 31 grasp the bags 100 coming out of the forming station 2, and a release position (not illustrated), in which they release the bags 100 of the group of bags 110 on the picking means 30.

Fifth operating means 45 are fixed to the frame means 20 and act on at least one of the carriages 34 to move the crosspiece means 33 and the third gripping elements 31 with alternating motion along the third advancement direction C.

In the illustrated embodiment, the picking means 30 comprise, for example, a conveyor 30 which forms a support surface L for supporting the bags 100. More precisely, the conveyor 30 comprises one or more movement belts 35 forming the horizontal support surface L for the bags 100. The movement belts 35 are closed loop, operated by sixth operating means 46 and move a plurality of bag rows 110 along the third advancement direction C towards the movement system 10 and the filling and closing station 4. The bag rows 110 lie on the horizontal support surface L of the conveyor 30 parallel to each other and spaced apart by a defined pitch along the third advancement direction C.

More precisely, the bag rows 110 are regularly spaced apart on the horizontal support surface L along the third advancement direction C by virtue of the alternating movement performed by the gripping elements 31 which grasp the bags 100 of the bag rows 110, arranged vertically coming out of the forming station 2, and move them in rotation around the rotation axis X and linearly along the third advancement direction C so as to arrange them horizontally on the conveyor 30, in particular with the upper side 103 open facing the forming station 2.

Figure 4:
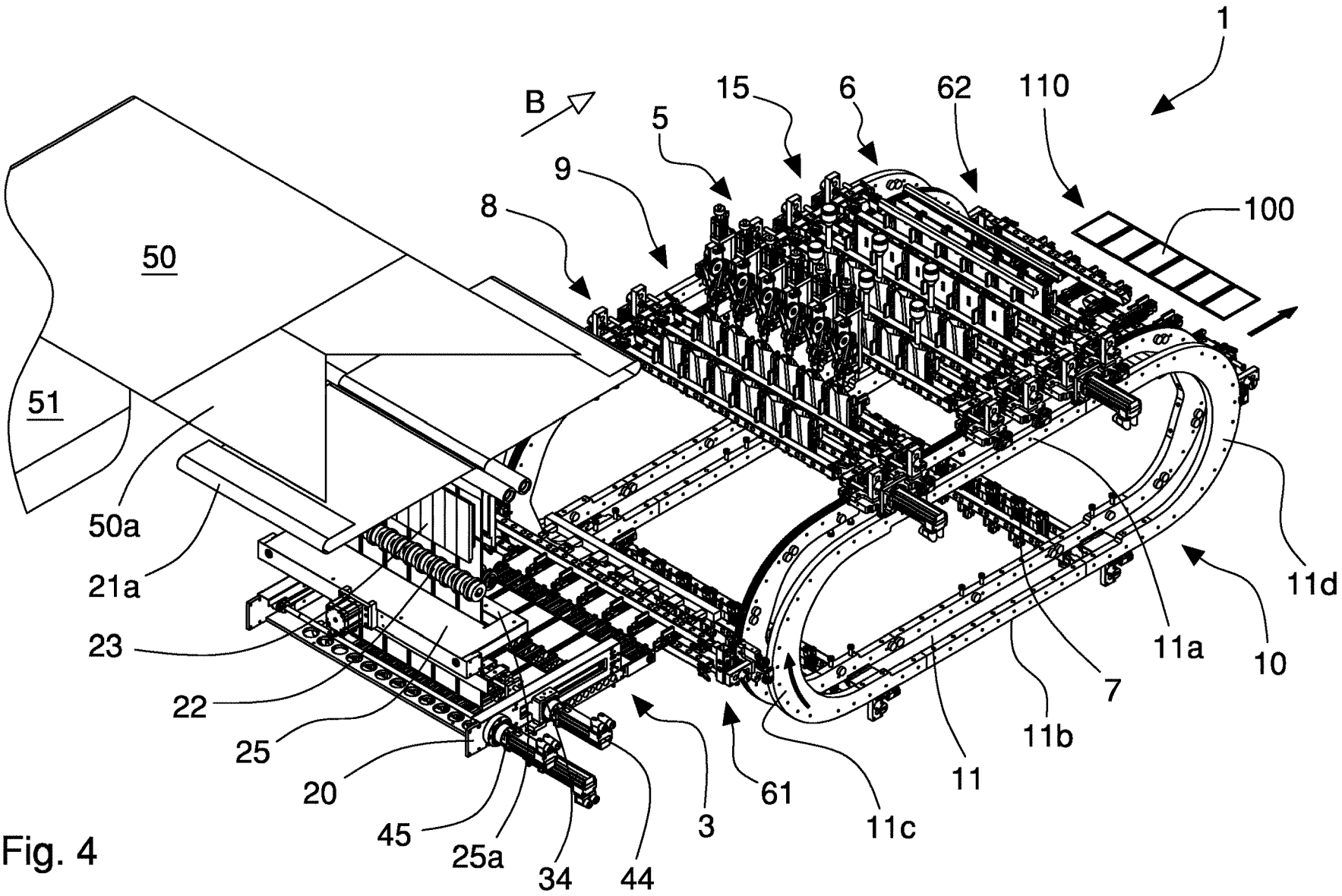
FIG. 4 is a schematic rear and perspective view of the packaging machine of FIG. 1.
Figure 6:
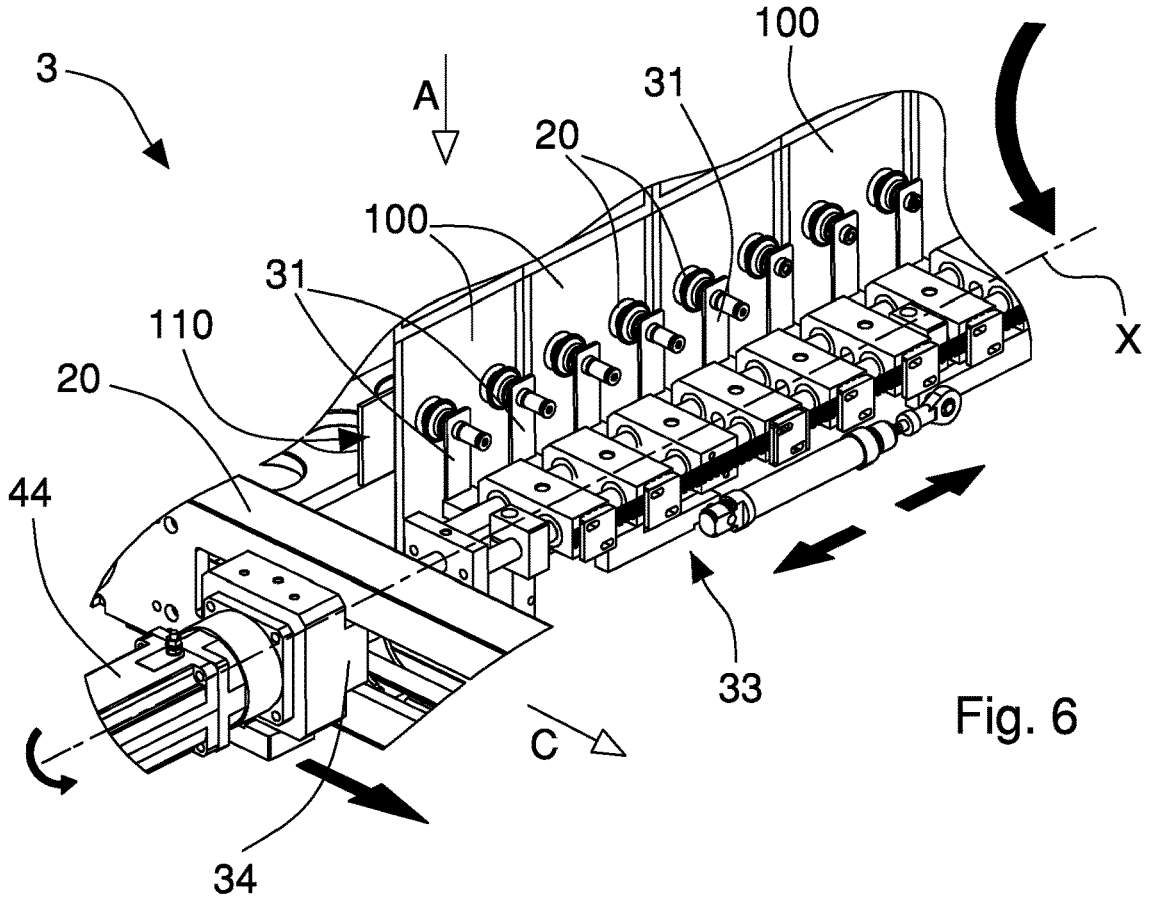
FIG. 6 is a partial enlarged view of FIG. 3 illustrating transfer means of the bags picked up from a forming station.
Figure 7:
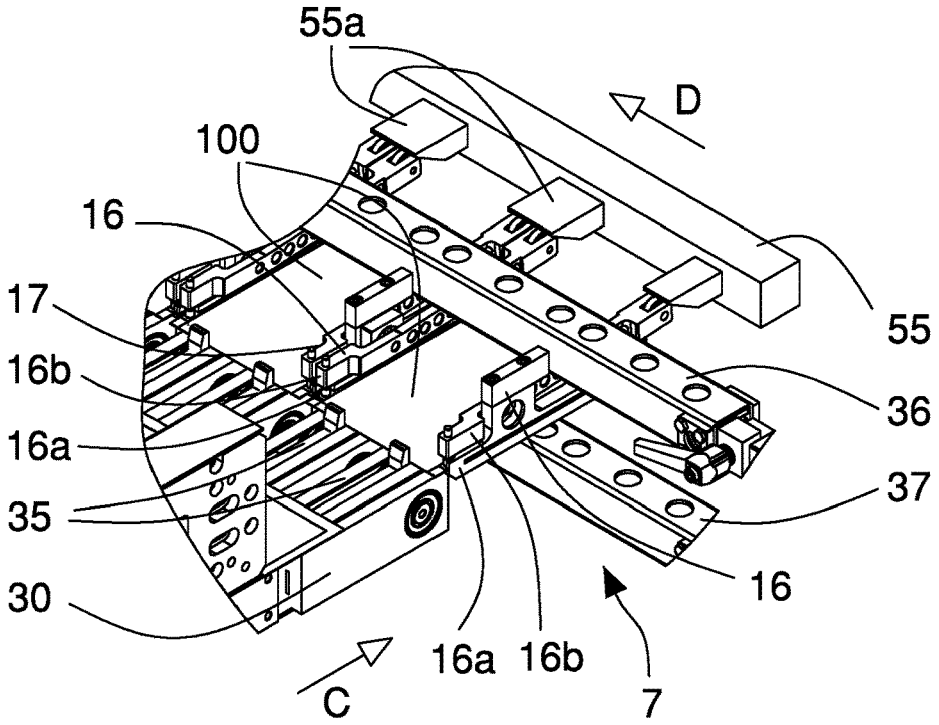
FIG. 7 is a partial enlarged view of FIG. 4 illustrating a gripping device of the bags of the movement system in a picking station.

With particular reference to FIGS. 1, 3 and 4, the forming station 2 comprises folding means 21 configured to fold the sheet 50 unwound by the reel 51 and obtain the two superimposed flaps 50*a*. The folding means 21 comprise, for example, a pair of fixed folding elements 21*a* and a pair of return rollers 21*b*.

In the embodiment of FIGS. 1-13, the forming station 2 also comprises a cutting element, of a known type and not illustrated, which longitudinally cuts the sheet 50 so as to generate the two distinct flaps 50*a* which the folding means 21 fold and superimpose. The pulling means 22 comprise, for example, a series of motorized rollers positioned downstream of the folding means 21 with reference to a movement direction of the two flaps 50*a* along the first advancement direction A.

The forming station 2 further includes welding means 23 configured to perform a series of "U" welds on the flaps 50*a* of the sheet 50, i.e., a plurality of longitudinal welds and transverse welds, respectively parallel and orthogonal to the first advancement direction A, intended to form the welds on the lateral edges 101 and on the lower edge 102 on each bag 100 of a bag row 110, respectively.

The welding means 23, of a known type and not described in detail, are interposed between the folding means 21 and the pulling means 22 with reference to the movement direction of the two flaps 50*a* and are moved, for example, with intermittent motion to perform the welds during a stopping step of the intermittent movement of the flaps 50*a* of the film 50.

The forming station 2 further includes cutting means 24, 25 arranged to cut the flaps 50*a* of the sheet 50 parallel and orthogonal to the first advancement direction A and obtain separate bags 100.

More precisely, the cutting means comprise first cutting means 24 for performing on the superimposed flaps 50*a* a plurality of longitudinal cuts, parallel to the first advancement direction A and second cutting means 25 for performing on the flaps 50*a* transverse cuts almost orthogonal to the first advancement direction A.

The first cutting means 24 comprise a plurality of cutting discs associated with, and abutted by, respective pulling discs of the pulling means 22 for moving and at the same time cutting the flaps 50*a* of the sheet 50.

The second cutting means 25 comprise, for example, a transverse blade 25*a* moved with intermittent motion to perform a transverse cut along the entire width of the flaps 50*a* of the sheet 50, during a stopping step of the advancement movement of the flaps 50*a* themselves. The operation of the packaging machine 1 of the invention includes the formation in the forming station 2 of bags 100 arranged on a plurality of parallel rows 110 on a substantially vertical movement plane M, starting from a sheet 50 of plastic material unwound by a reel 51.

More precisely, the folding means 21 fold the sheet 50 unwound by the reel 51 so as to obtain the two superimposed flaps 50*a* and the pulling means 22 unwind the sheet 50 from the reel 51 and move the aforementioned flaps 50*a* on the movement plane M along the first vertical advancement direction A, for example with intermittent motion. A cutting element longitudinally cuts the sheet 50 to generate the two distinct flaps 50*a* of the sheet 50.

The welding means 23 of the forming station 2 perform on the flaps 50*a* of the sheet 50 the plurality of longitudinal welds and the transverse welds, respectively parallel and orthogonal to the first advancement direction A.

The cutting means 24, 25 cut the flaps 50*a* of the sheet 50 parallel and orthogonal to the first advancement direction A at the longitudinal and transverse welds so as to obtain the bags 100 separated and aligned so as to form bag rows 110 parallel to each other and orthogonal to the first advancement direction A. The bags 100 thus obtained have the lateral edges 101 and the lower edge 102 hermetically closed by the welds and the open edge or upper side 103, i.e., provided with an access opening.

The welding means 23 and the second cutting means 25 are moved, for example, with intermittent motion to perform the respective machining on the flaps 50*a* of the stationary sheet 50, in the stopping intervals of the advancement motion.

After the transverse cutting performed by the second cutting means 25, each bag row 110 thus obtained is grasped by the pairs of third gripping elements 31 of the transfer means 3. More precisely, each pair of third gripping elements 31 grasps a respective bag 100 of the bag rows 110 and deposits it on the conveyor 30.

After being grasped by the third gripping elements 31, the bags 100 of the bag rows 110 are spaced apart along a direction parallel to the movement plane M and orthogonal to the first advancement direction A, suitably moving the pairs of third gripping elements 31.

The bag row 110 is then rotated and translated by the third gripping elements 31 and deposited on the horizontal support surface L of the conveyor 30 arranged orthogonally to the third advancement direction C, the bags 100 arranged with the upper edges 103 facing the forming station 2.

The bag rows 110 are regularly spaced apart on the horizontal support surface L formed by the movement belts 35 of the conveyor 30 and are moved by the latter along the third advancement direction C towards the movement system 10 and the filling and closing station 4. At the picking station 61 of the movement system 10, the bag rows 110 are grasped and picked up one at a time by the gripping devices 7 of the movement system 10.

More precisely, the pairs of grippers 16, 17 of each gripping device 7 grasp the opposite lateral edges 101 of a respective bag 100 of a bag row 110 positioned at the picking station 61 exiting the conveyor 30. The relative distance between the grippers 16, 17 of each pair of grippers 16, 17 can be adjusted in an initial setting step of the packaging machine 2 based on the width of the bags 100, i.e., based on the length of the edge or upper side 103 of the bag 100.

The gripping devices 7, which are connected and supported by the movement carriages 12 movable along the guide rails 11, transport the bag rows 110 in succession through the filling and closing station 4 in particular along the first operating section 11*a* of the aforementioned guide rails 11 with intermittent motion. The bags 100 of each bag row 110 are held vertical by the gripping devices 7.

In the opening station 8 the bags 100 are laterally pressed to spread apart the access opening on the upper edge 103 and allow the subsequent introduction of the product into the bag 100. In particular, the bags 100 are opened by approaching the first gripper 16 and the second gripper 17 of each pair of grippers 16, 17 along the transverse direction D. The grippers 16, 17 are moved by the first operating means 41. The bags 100 are also opened by the pairs of gripping elements 18, 19 acting on the opposite walls of the bags 100 and operated so as to move away and detach the aforementioned walls.

In the opening control station 9, the feeler elements 29 are moved vertically so as to fit inside the bags 100 when the access opening has been properly spread apart or to abut the upper edges 103 of the bags 100 when the access opening has not been sufficiently spread apart. In the latter case, stopping the feeler elements 29 against the upper edges 103 of the bags 100 causes an alarm signal to be sent to the control unit 40 of the packaging machine 1 which, for example, inhibits the dosing of the product(s) in the closed bags in the dosing station(s).

In the first dosing station 5 and/or the second dosing station 15 the product(s) is/are dosed inside the bags 100 by means of the dispensers 48, 49 vertically moved to approach the bags 100.

In the subsequent closing station 13, the bags 100 are closed at the upper edge 103 by moving the first gripper 16 and the second gripper 17 of each pair of grippers 16, 17 away along the transverse direction D, in particular by operating the second operating means 42.

In the welding station 6 the respective welding means 60 weld and hermetically and simultaneously close all the upper edges 103 of the bags 100 of each bag row 110.

The bags 100 filled with the product and then closed are subsequently transferred from the movement system 10 to the release station 61 at which the gripping devices 7 release the bags 100 to the further movement means 14 for the exit from the packaging machine 1.

Once the bag rows 110 are released, the movement carriages 2 are moved by the linear electric motor 26 in continuous motion from the release station 62 to the picking station 61. i.e., along the second return section 11*b* and part of the third and fourth curvilinear sections 11*c*, 11*d* of each guide rail 11, with a much higher speed than that at which they are moved along the first operating section 11*a*. Thereby, the movement system 10 can comprise a much lower number of movement carriages 12 than is necessary in the traditional and well-known belt or conveyor belt movement systems in which the movement carriages or the support elements of the gripping devices 7 are fixed to each other regularly spaced apart along the entire extension or length of the closed loop conveyor belt.

It should be noted that by virtue of the packaging machine 1 of the invention it is possible to dose one or more products inside the bags 100 when the latter are at room temperature in order to avoid deterioration and alteration of the products themselves, in particular in the case of pharmaceutical products. The dosing stations 5, 15 positioned in the filling and closing station 4 and in which the bags 100 are filled with the product or products, are in fact separate and distant from the forming station 2, in which the lateral edges 101 and lower edges 102 of the bags 100 are welded. Thereby, it is possible to have the plastic material of the bags 100 completely cooled in all the parts thereof before the filling with the product. The packaging machine 1 of the invention is also very flexible and versatile since it allows to dose a plurality of different products by including respective dosing stations 5, 15 in the filling and closing station 4 without significantly increasing the dimensions and longitudinal footprint (along the second and third advancement direction B, C) of the packaging machine 1. Such an advantage is also obtained by virtue of the forming station 2 in which the folding 21, welding 23 and cutting 24, 25 means are arranged along a vertical movement plane M having a limited overall plan footprint.

The arrangement of the forming 21, welding 23 and cutting 24, 25 means of the forming station 2 further allows to make parallel rows of bags 100 which are transferred by the transfer means 3 to the filling and closing station 4 for dosing and closing and welding. Each bag row 110 (horizontally aligned) is formed by a defined number of bags 100 which is selectable and modifiable according to the specific productivity needs required of the packaging machine 1. It should be noted that also in this case the increase in the number of bags 100 of each bag row 110 does not result in a significant increase in the transverse dimensions (orthogonal to the second and third advancement directions B, C) of the packaging machine 1. The bags 100 of each bag row 110 are simultaneously filled with the product or products in the dosing stations 5, 15 in a stopping step of the intermittent motion with which movement carriages 12 are moved, and then the gripping devices 7, in the first operating section 11*a* of the guide rails 11 of the movement system 10. Thereby, the packaging machine 1 of the invention allows to achieve high production speeds, i.e., to produce a high number of high quality bags 100 per unit of time.

Finally, it should be noted that by virtue of the limited number of movement carriages 12 and the rapid movement with continuous motion thereof, in particular along the second return section 11*b* of the guide rails 11, the possibility that the aforementioned movement carriages 12 and the gripping devices 6 mounted thereon can be dirtied by the product dispensed in the dosing stations 5, 15 and fallen out of the bags 110 is greatly reduced, allowing to simplify the cleaning procedures of the packaging machine 1 and reduce the time required to perform said procedures.

Referring to FIGS. 14 to 17, a variant of the packaging machine 1 of the invention is illustrated which differs from the embodiment described above and illustrated in FIGS. 1 to 13 in that it does not comprise transfer means 3 interposed between the forming station 2 and the movement system 10 and intended to transfer the bag rows 110.

In this variant of the packaging machine 1, the forming station 2 is, for example, positioned above the movement system 10 so as to release the bag rows 110, one at a time, to the gripping devices 7. The latter are in particular positioned in the picking station 61 below the second cutting means 25 of the forming station 2. Thereby, the pairs of grippers 16, 17 of the gripping device 7, arranged in the opening configuration by the first actuating means 55, are capable of receiving and then retaining a bag row 110 coming from the overlying forming station 2.

The subsequent opening 8, opening control 9, dosing 5, 15, closing 13, welding 6 and release 62 stations are identical to those of the packaging machine illustrated in FIGS. 1-13 and the operation thereof during the packaging process of the bags 100 is substantially identical.

The invention claimed is:

1. A packaging machine for packaging at least one product in bags, the packaging machine comprising:

a forming station for making bags from a sheet of plastic material, said forming station comprising:

a folding assembly for folding the sheet and obtaining two superimposed flaps;

a pulling assembly for unwinding the sheet from a reel and moving the two superimposed flaps on a movement plane that is substantially vertical along a first advancement direction that is substantially vertical and downwardly oriented;

welding devices configured to weld the superimposed flaps, said welding devices being arranged side by side to form a plurality of rows of bags parallel to each other and orthogonal to the first advancement direction, and said welding devices welding for each of the bags two lateral sides aligned parallel to the first advancement direction and one bottom side orthogonal to the two lateral sides, so as to have a U-shaped weld that leaves an access opening along a respective upper side; and cutting devices configured to separate the welded bags from each other;

a filling and closing station comprising at least a dosing station for dosing a product in the bags and a welding station for welding and closing the bags at the upper side; and a movement system comprising a plurality of gripping devices that are mobile and configured to move the rows of bags along a second advancement direction from said forming station to said dosing station and then to said welding station, each of the rows of bags being kept substantially aligned orthogonally to the second advancement direction when moved from said forming station to, and through, said filling and closing station.

2. The packaging machine according to claim 1, wherein said movement system further comprises at least one guide rail, which extends along a closed loop movement path, and a plurality of movement carriages movable along said guide rail, each of said movement carriages supporting a respective one of said gripping devices.

3. The packaging machine according to claim 2, wherein said movement system further comprises a pair of guide rails that each support a respective plurality of movement carriages, each of said gripping devices being supported and moved by two of said movement carriages each of which is associated with a respective one of said pair of guide rails.

4. The packaging machine according to claim 2, wherein said movement system further comprises at least one linear electric motor having a stator associated with a respective guide rail and extending along an entirety of the closed loop movement path and a plurality of rotors each of which is associated with a respective one of said movement carriages and interacting separately and independently with magnetic fields generated by said stator.

5. The packaging machine according to claim 4, further comprising a control unit connected at least to said movement system and configured to control said linear electric motor so as to move said movement carriages with intermittent motion along a first rectilinear operating section of said guide rail from said forming station to said dosing station and to said welding station and with a continuous motion along a second rectilinear return section towards said forming station.

6. The packaging machine according to claim 1, wherein said movement system further comprises a conveyor arrangement extending along a closed loop movement path and configured to support and move said plurality of gripping devices.

7. The packaging machine according to claim 1, wherein each of said gripping devices comprises a plurality of pairs of grippers that are aligned along a transverse direction, each of said pairs of grippers being adapted to grasp opposite lateral edges of a respective bag of one of the rows of bags.

8. The packaging machine according to claim 7, wherein the transverse direction is substantially orthogonal to the second advancement direction.

9. The packaging machine according to claim 7, wherein each of said pairs of grippers comprises a first gripper and a second gripper movable closer to or away from each other along the transverse direction respectively to open, the bag by moving respective lateral edges of the bag closer to each other so as to detach opposite walls of the bag at an upper edge, and to close the bag by moving the respective lateral edges away from each other so as to make the opposite walls of the bag abut each other at the upper edge.

10. The packaging machine according to claim 9, wherein said filling and closing station further comprises an opening station positioned upstream of said dosing station with reference to the second advancement direction, said opening station comprising a movable opening element to spread apart the access opening of the bags and a first operating unit for bringing said first gripper and said second gripper of each of said pairs of grippers closer to each other.

11. The packaging machine according to claim 1, wherein said filling and closing station further comprises an opening station positioned upstream of said dosing station with reference to the second advancement direction, said opening station comprising movable opening elements to spread apart the access opening of the bags.

12. The packaging machine according to claim 1, further comprising a transfer assembly for picking up and removing one by one each of the rows of bags from said forming station and then transferring the rows of bags to said movement system.

13. The packaging machine according to claim 12, wherein said transfer assembly comprises a plurality of pairs of third gripping elements configured to grasp and transfer the rows of bags coming out of said forming station and a picking system interposed between said forming station and said movement system, said picking system being configured to receive from said pairs of third gripping elements the rows of bags and move the rows of bags along a third advancement direction towards said gripping devices of said movement system.

14. The packaging machine according to claim 13, wherein said picking system comprises a conveyor forming a horizontal support surface for supporting the bags and being mobile for moving a plurality of the rows of bags along the third advancement direction towards said movement system, the plurality of the rows of bags lying on said horizontal support surface parallel to each other and aligned orthogonally to the third advancement direction.

* * * * *